US011017634B2

(12) United States Patent
Hsu et al.

(10) Patent No.: US 11,017,634 B2
(45) Date of Patent: May 25, 2021

(54) GAME SYSTEM WITH MECHANISM FOR DETERMINING WHETHER TO TRIGGER THREE-DIMENSIONAL RE-SPINNING

(71) Applicant: JUMBO TECHNOLOGY CO., LTD., Taichung (TW)

(72) Inventors: Shun-Tsung Hsu, Taichung (TW); Chang-Yi Wang, Taichung (TW)

(73) Assignee: JUMBO TECHNOLOGY CO., LTD., Taichung (TW)

( * ) Notice: Subject to any disclaimer, the term of this patent is extended or adjusted under 35 U.S.C. 154(b) by 0 days.

(21) Appl. No.: 16/373,194

(22) Filed: Apr. 2, 2019

(65) Prior Publication Data

US 2020/0320828 A1 Oct. 8, 2020

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 6,602,137 | B2 | 8/2003 | Kaminkow et al. | |
| 6,955,600 | B2 | 10/2005 | Glavich et al. | |
| 8,197,328 | B2 | 6/2012 | Bluemel | |
| 8,444,475 | B2 | 5/2013 | Hsu | |
| 10,176,670 | B2 | 1/2019 | Hsu | |
| 2015/0080086 | A1* | 3/2015 | Weiss | G07F 17/3265 463/20 |
| 2016/0078710 | A1* | 3/2016 | Pierer | G07F 17/3211 463/31 |
| 2018/0130286 | A1* | 5/2018 | Berman | G07F 17/3209 |
| 2018/0308312 | A1* | 10/2018 | Weiss | G07F 17/3211 |

* cited by examiner

*Primary Examiner* — Lawrence S Galka
(74) *Attorney, Agent, or Firm* — Muncy, Geissler, Olds & Lowe, P.C.

(57) ABSTRACT

The present invention is to determine whether a game result of a slot machine satisfies a specified condition by using a control unit, the specified condition is defined as any one of the plurality of game symbols in the game result replaced so that the reward condition is satisfied, and one of the game symbols replaced to be located at a replacement position; when the control unit determines that the game result satisfies the specified condition, the control unit activates a three-dimensional re-spinning component to generate a replacement game symbol. The replacement game symbol is used to replace the game symbol at the replacement position and update the game result, thereby the control unit re-determines whether the updated game result meets the reward condition, and after the reward condition is met, performs a reward program by using a reward unit.

13 Claims, 12 Drawing Sheets

GAME SYSTEM WITH MECHANISM FOR DETERMINING WHETHER TO TRIGGER THREE-DIMENSIONAL RE-SPINNING

FIELD OF THE INVENTION

The present invention relates to a game system, and more particularly to a game system for determining whether to trigger a three-dimensional re-spinning mechanism.

BACKGROUND OF THE INVENTION

Referring to FIG. 1, a conventional slot machine 1 comprises a plurality of rollers 2, and after a bet is placed by a player, the rollers 2 are activated to spin, a score is obtained according to the arrangement of symbols formed after the rollers 2 stop, and when a specific symbol appears or a preset condition is met, an extra game of a certain number of rounds is entered or an extra score is given. The features of playing this extra game are free spin, multiple scores and all-match symbols to be locked up, high scores, etc., which allow the player to get high scores with high probability but without additional costs, so the player will look forward to win big prize in the extra game, which is one of the important features to attract the player to use the slot machine 1.

Common game modes of the extra game are selected from re-spinning of rollers, bonus game, free game, retrigger, and jackpot.

The re-spinning of rollers is as shown in procedures in FIG. 4 of U.S. Pat. No. 8,197,328 B2; the bonus game is as shown in FIGS. 1A, 1B, 3, 4, 5, 6, 7 and 8, and lines 34 to 50 of column 6 of the description of U.S. Pat. No. 6,602,137 B2; as for the free game and retrigger, can be found in FIGS. 3A, 3B and 4, and lines 2 to 57 of column 6 of the description of U.S. Pat. No. 6,955,600 B2; and the jackpot can be referred to U.S. Pat. No. 10,176,670 B2.

However, under the completely random setting, even in the extra game of high probability for winning prize, there is a probability that the player is unable to win any prize in the process of the extra game, or there is a winning but not many scores are accumulated. In this situation, the player will suddenly turn an expectation mood into a disappointing mood for failing winning a prize or only winning a small prize, which is easy for the player to generate negative emotions, thus reducing the player's interest in using the slot machine 1. More specifically, once the player did not get the expected amount of scores, after the extra game ends, the player might directly end the game, which instead affects the usage rate of the slot machine 1, thereby reducing the profits of the slot machine 1.

Therefore, there are currently many techniques for enhancing or maintaining the player's desire to use the slot machine 1, one of which is the U.S. Pat. No. 8,444,475 B2, which is designed to set a threshold and repeat execution of extra games to accumulate scores of the extra games when the set threshold is not reached, and stop until the player reaches compensating the set threshold. Thereby ensuring that the player gains certain benefits in the extra games while meeting the player's expectations to avoid reducing the profits of the slot machine 1.

The aforementioned technique can guarantee the player to get certain benefits in the extra games, but it can not increase the probability of the player entering the extra game. When the player is unable to enter the extra game for a long time, or often lacks one symbol to enter the extra game or get extra scores, it is also easy to have a sense of loss. When this situation persists for a long time, the player's interest in playing the game will be greatly reduced, thereby reducing the usage rate of the slot machine 1.

SUMMARY OF THE INVENTION

A main object of the present invention is to disclose a system that make a player to re-expect winning a prize, thereby maintaining the player's interest for a long time and increasing an usage rate of the slot machine.

In order to achieve the above object, the present invention provides a game system with mechanism for determining whether to trigger three-dimensional re-spinning, which is applied to a slot game, the slot game comprises a plurality of game results, the game system comprises a display component, a game result generating component, a three-dimensional re-spinning component, a reward unit and a control unit, wherein the display component comprises a game screen for displaying a real-time image of the slot game; the game result generating component generates a plurality of game symbols, the plurality of game symbols are displayed side by side on the game screen, and the slot game constitutes the different game results according to arrange the type of the plurality of game symbols; the three-dimensional re-spinning component comprises a stereoscopic image displayed on the game screen, the stereoscopic image comprises at least four display surfaces arranged stereoscopically, the at least four display surfaces respectively includes one of the game symbols, the three-dimensional re-spinning component randomly selects any one of the at least four display surfaces, the stereoscopic image presents a randomly selecting process in a stereoscopic spinning manner, and the three-dimensional re-spinning component, displaying one of the display surfaces that being selected to face in front, and at the same time the three-dimensional re-spinning component makes one of the game symbols corresponding to one of the display surface that being selected as a replacement game symbol; the reward unit performs a reward program when the slot game instantaneously generates the game result that satisfies a reward condition; and the control unit is connected to the display component, the game result generating component, the three-dimensional re-spinning component, and the reward unit.

In addition, the control unit of the present invention controls the game to perform the following steps:

step S1: determining procedure, the control unit determining whether the slot game instantaneously generating the game result that satisfying a specified condition, the specified condition defined as any one of the plurality of game symbols in the game result, replaced so that the reward condition may be satisfied, and one of the game symbols replaced to be located at a replacement position, and when the control unit determining that the game result satisfying the specified condition, the control unit generating an activation signal;

step S2: re-spinning procedure, the control unit transmitting the activation signal to the three-dimensional re-spinning component, the three-dimensional re-spinning component generating the replacement game symbol after receiving the activation signal, and the replacement game symbol being used to replace the game symbol at the replacement position and update the game result;

step S3: determining whether rewarding, the control unit re-determining whether the updated game result satisfying the reward condition, if yes, the control unit generating a reward signal; and step S4: performing reward, the control unit notifying the reward unit to perform the reward program.

Accordingly, the present invention compares whether the game result generated by the slot game instantaneously satisfies the specified condition through the control unit and by using the determining procedure. After the specified condition is satisfied, the control unit transmits the activation signal to the three-dimensional re-spinning component, thereby generating the replacement game symbol, and the replacement game symbol is used to replace the game symbol at the replacement position and update the game result. Thus the control unit can determine once again whether the game result meets the reward condition, and the player re-expects to meet the reward condition to perform the reward program. Therefore, the player is given a similar excitement of squinting a card through the operation of the three-dimensional re-spinning component, and at the same time the player re-expects a chance of winning a prize, thereby enhancing the player's interest in playing.

DETAILED DESCRIPTION OF THE PREFERRED EMBODIMENTS

The detailed description and technical content of the present invention will now be described with reference to the accompanying drawings as follows.

Figure 1:
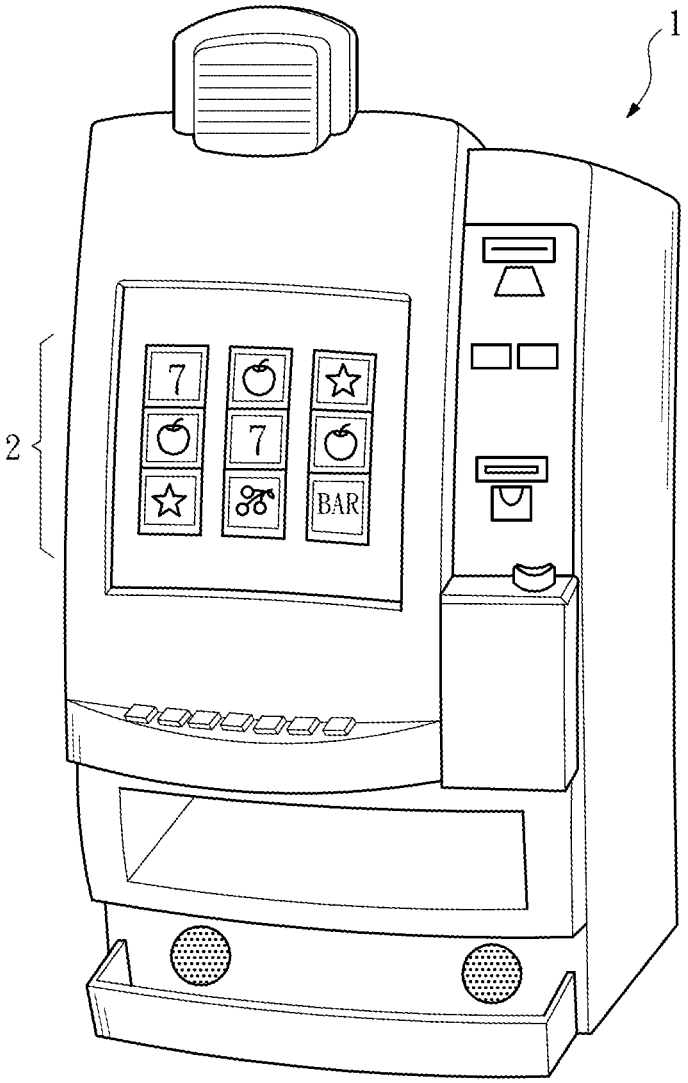
Fig. 1 PRIOR ART
FIG. 1 is a schematic diagram of the appearance of a conventional slot machine.
Figure 2:
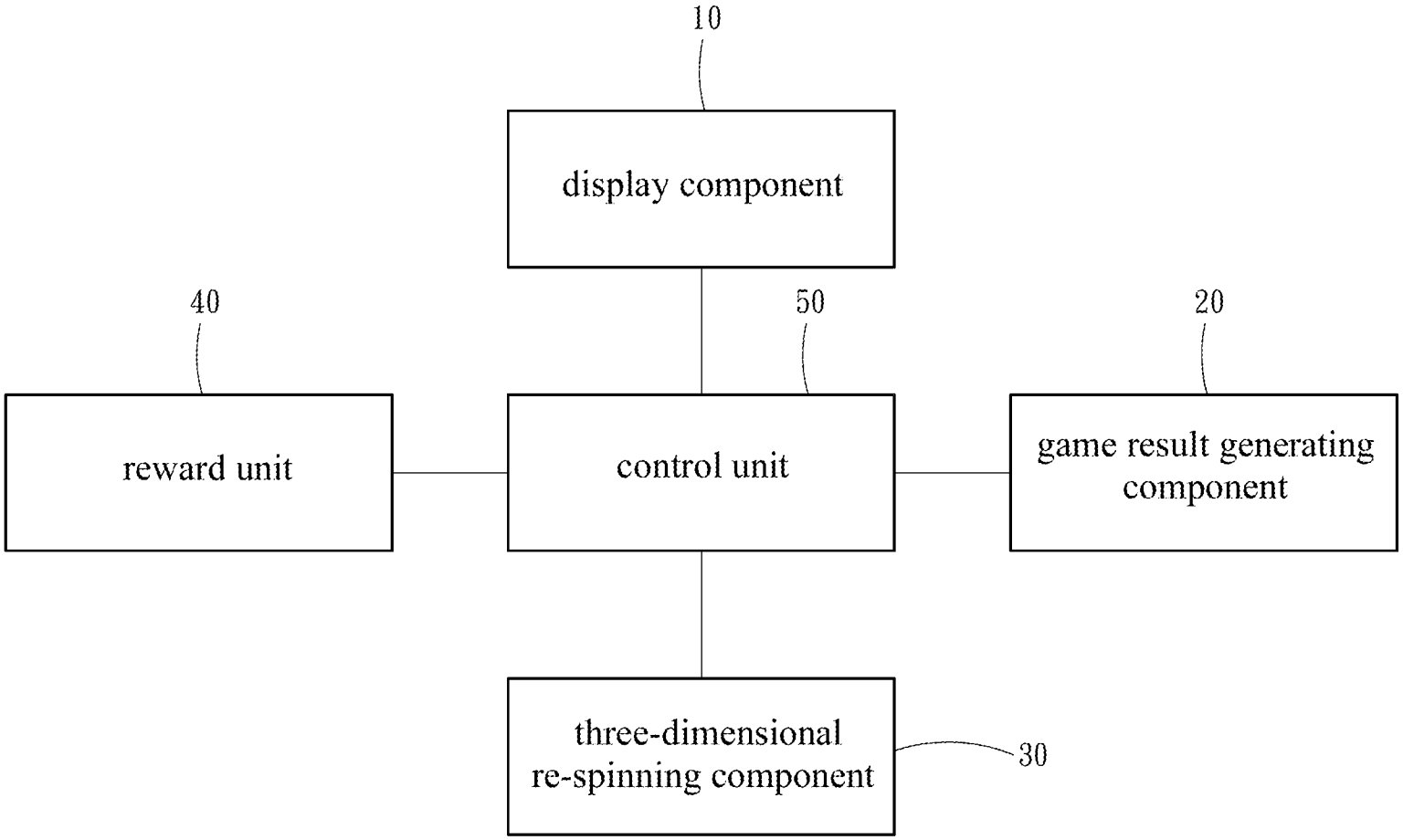
FIG. 2 is a system block diagram of the present invention.
Figure 3:
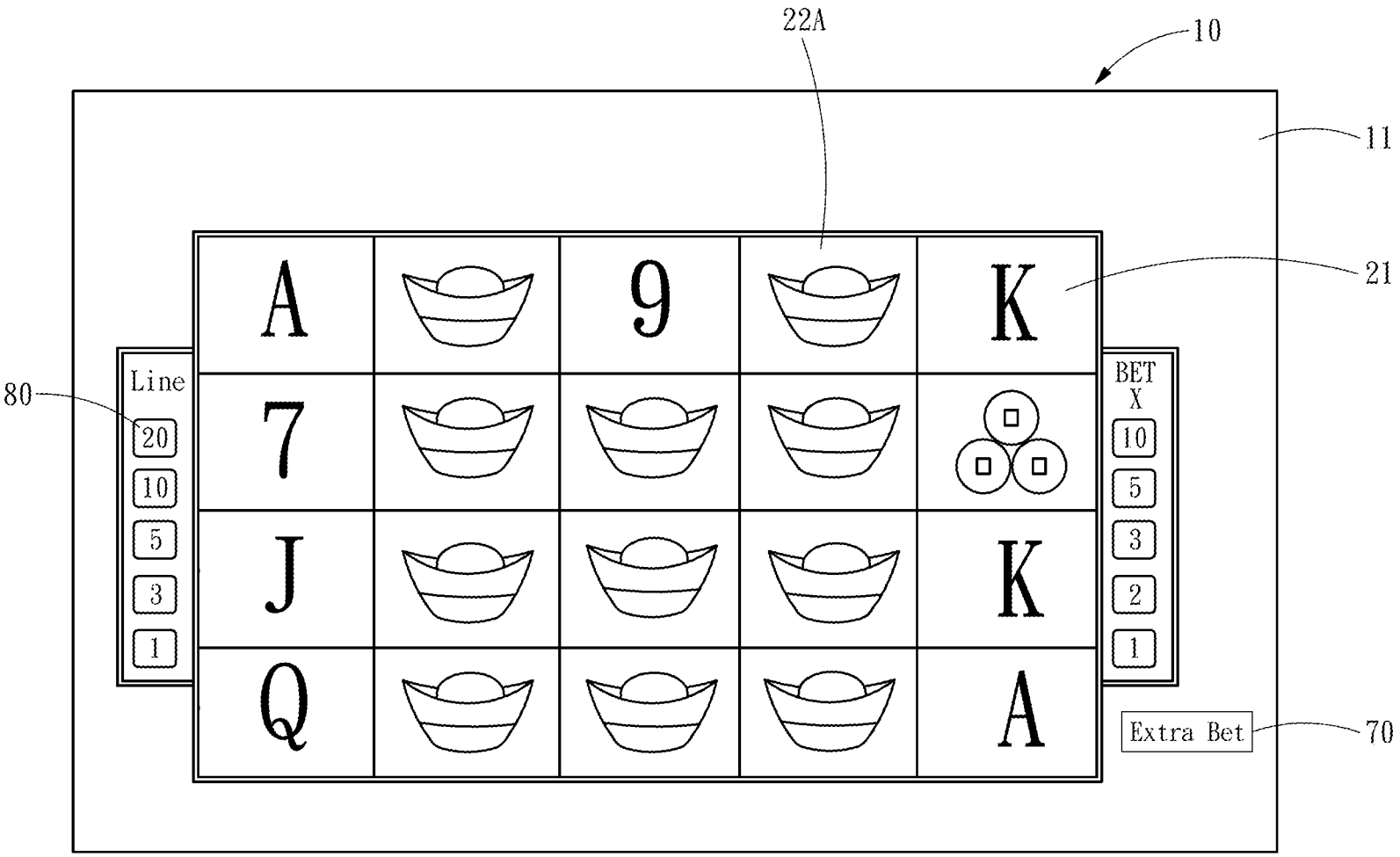
FIG. 3 is a schematic diagram of a game screen of the present invention.

Referring to FIGS. 2 and 3, the present invention is a game system with mechanism for determining whether to trigger three-dimensional re-spinning, which is applied to a slot game. The slot game includes a plurality of game results, and the game system comprises a display component 10, a game result generating component 20, a three-dimensional re-spinning component 30, a reward unit 40 and a control unit 50, wherein the display component 10 comprises a game screen 11 for displaying a real-time image of the slot game, and the game result generating component 20 generates a plurality of game symbols 21, the plurality of game symbols 21 are displayed side by side on the game screen 11, and the slot game constitutes the different game results according to arrange the type of the plurality of game symbols 21. The game result generating component 20 can be a plurality of roller elements 22A in the actual implementation structure, wherein each of the roller elements 22A comprises a roller, and each of the roller elements 22A generates any one of the plurality of game symbols 21 through rolling, that is, the plurality of game symbols 21 are respectively generated by a corresponding number of the roller elements 22A.

Figure 4:
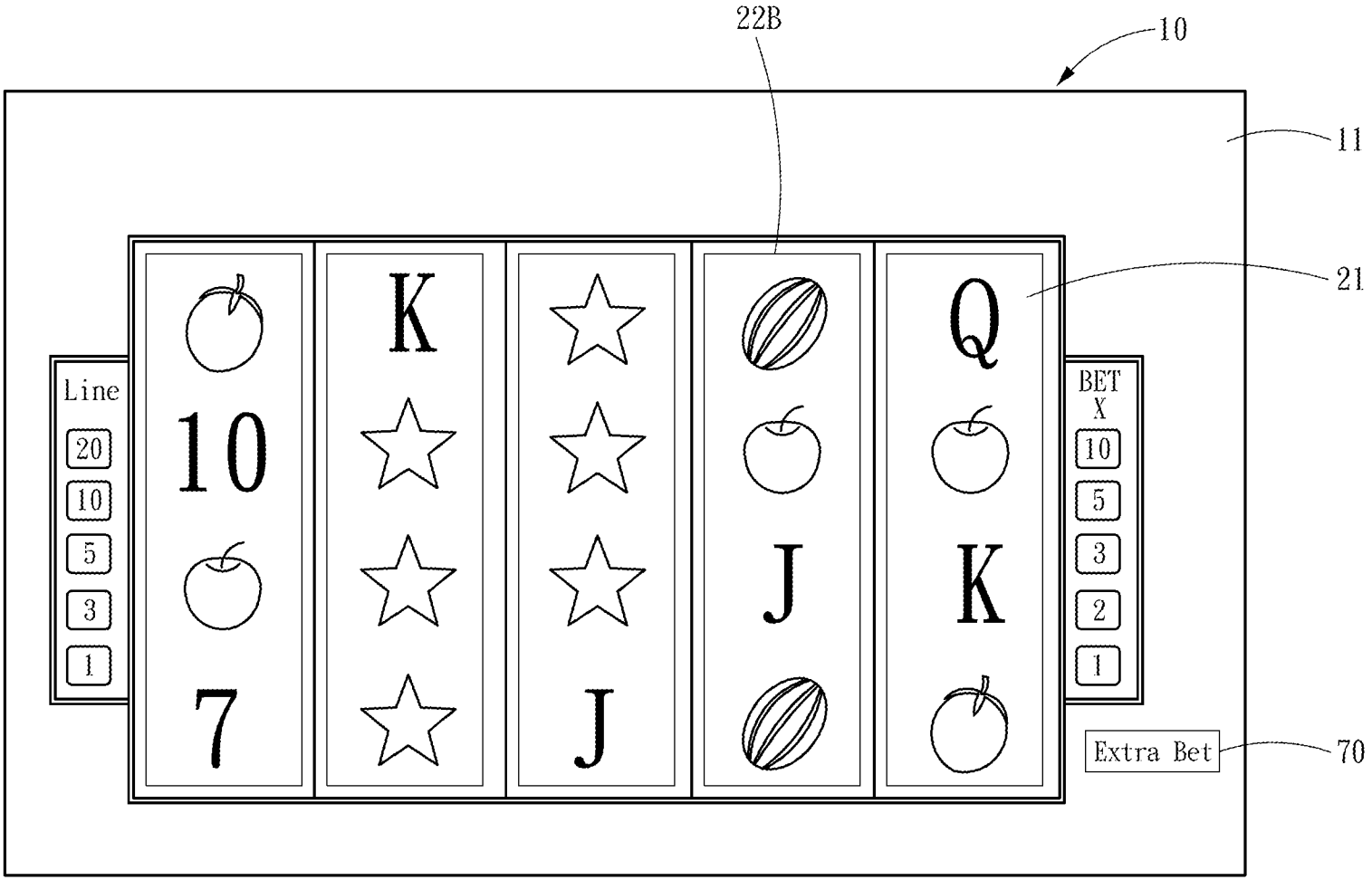
FIG. 4 is a schematic diagram of the game screen according to another implementation mode of the present invention.

Or, referring to FIG. 4, another implementation mode that comprises a plurality of roller elements 22B. Each of the plurality of roller elements 22B generates the plurality of game symbols 21 in a row, that is, the plurality of game symbols 21 in the row are displayed by rolling from top to bottom continuously. For example, when the game screen 11 simultaneously displays the plurality of game symbols 21 arranged in a 4×5 matrix, the game screen 11 comprises five of the roller elements 22B, and each of the roller elements 22B simultaneously displays four columns of the game symbols 21, the game symbols 21 will move from the first column to the second column at the time, then move to the third column, and finally move to the fourth column, and then disappear from the game screen 11.

Figure 5:
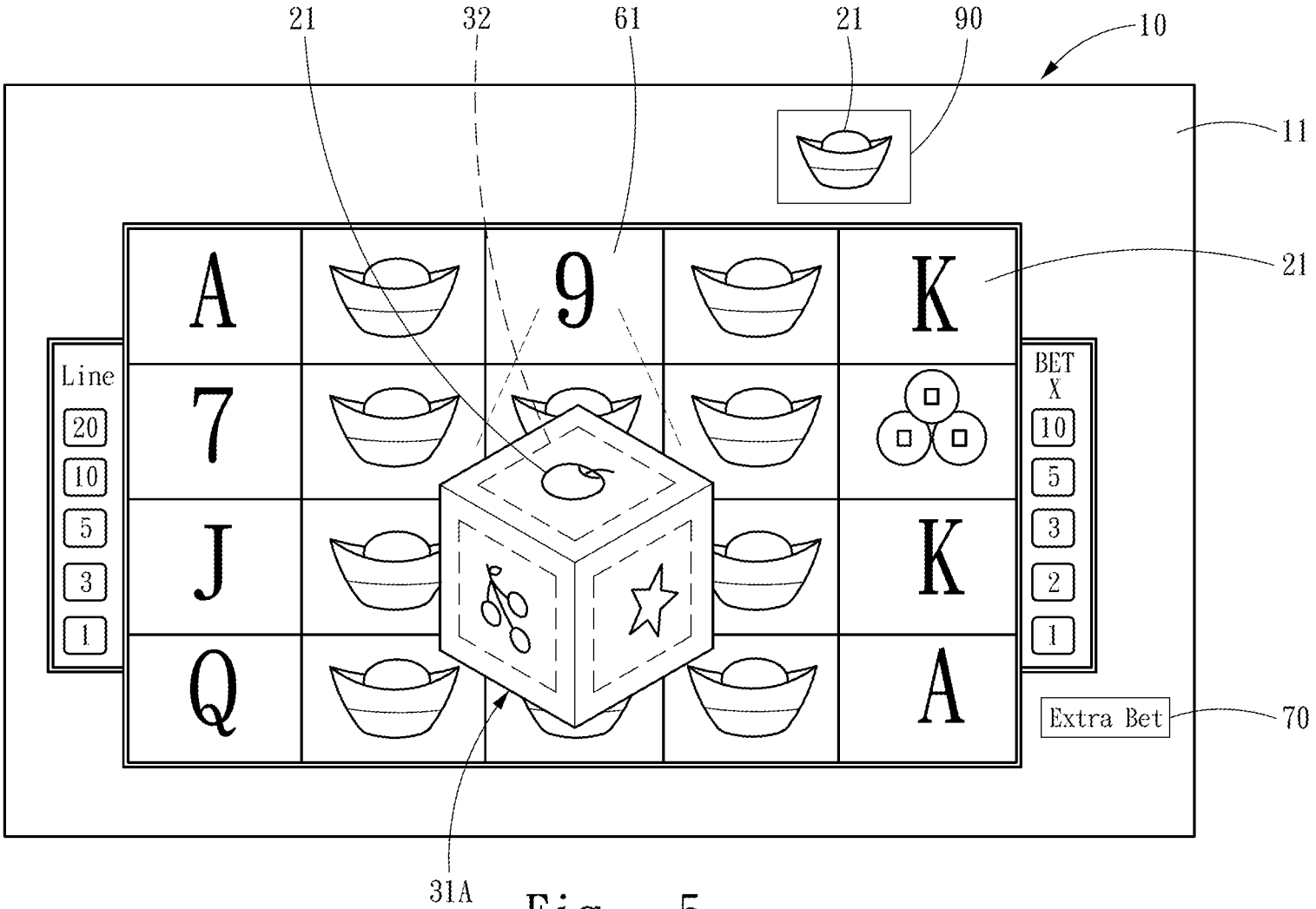
FIG. 5 is a schematic diagram of a three-dimensional re-spinning component of the present invention.

The three-dimensional re-spinning component 30 comprises a stereoscopic image 31A displayed on the game screen 11, and the stereoscopic image 31A comprises at least four display surfaces 32 arranged stereoscopically. As shown in FIG. 5, the stereoscopic image 31A of the three-dimensional re-spinning component 30 can be a six-sided dice which is in the form of a general dice, and a quantity of the display surfaces 32 can be six and the display surfaces 32 are respectively located on six sides of the six-sided dice.

Figure 6:
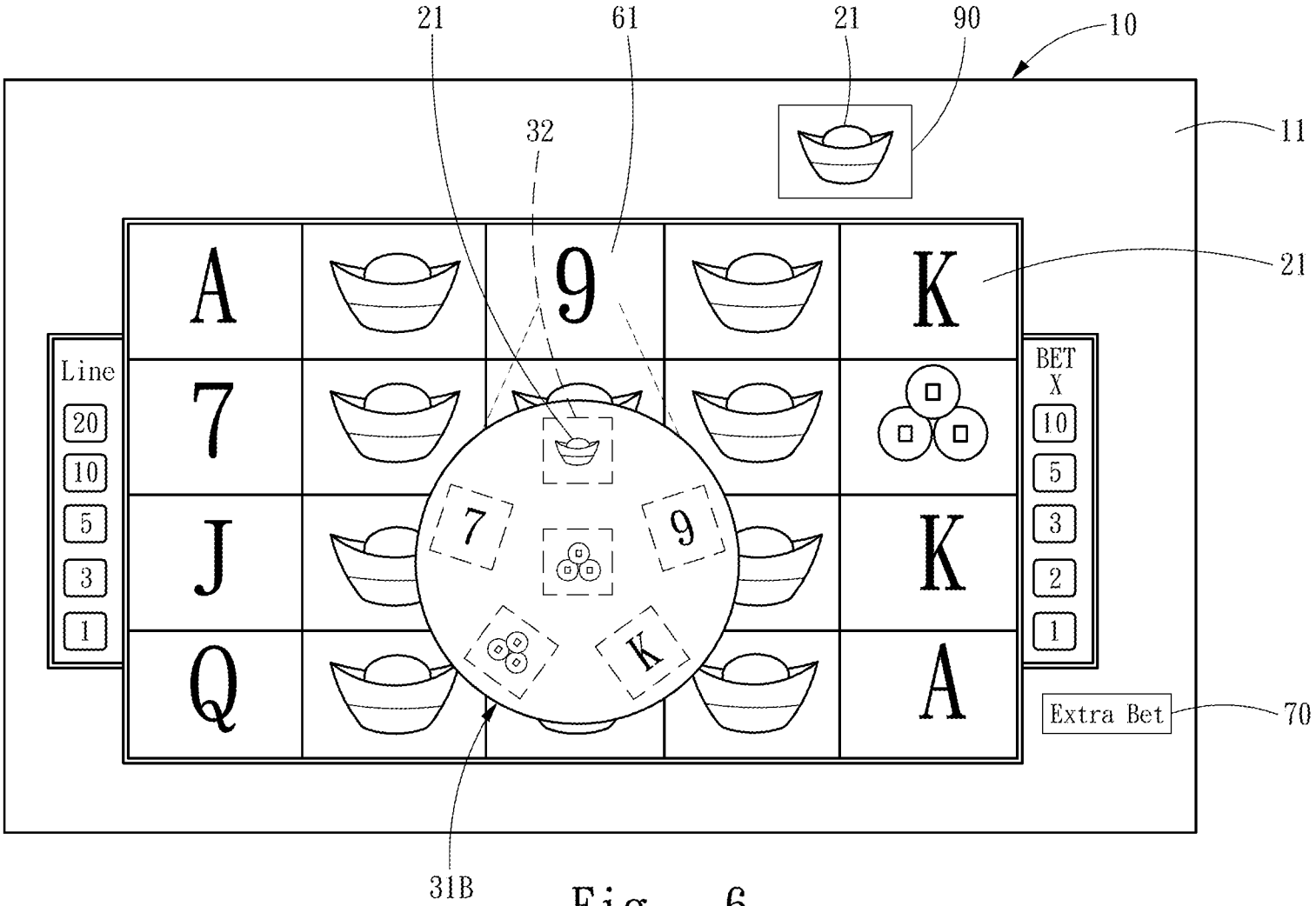
FIG. 6 is a schematic diagram of the three-dimensional re-spinning component according to another implementation mode of the present invention.

Or, as shown in FIG. 6, a stereoscopic image 31B of the three-dimensional re-spinning component 30 can also be a spheroid (as drawn in FIG. 6) or a tetrahedron; if the stereoscopic image 31B is a spheroid, the at least four display surfaces 32 are embedded on outer surfaces of the spheroid. Further, the at least four display surfaces 32 respectively comprise one of the plurality of game symbols 21, and in the game design, the types of the plurality of game symbols 21 of the three-dimensional re-spinning component 30 can be the same as the types of the plurality of game symbols 21 of the game result generating component 20; alternatively, a quantity of the types of the plurality of game symbol 21 of the three-dimensional re-spinning component 30 can be more than the types of the plurality of game symbols 21 of the game result generating component 20, such as the plurality of game symbols 21 of the three-dimensional re-spinning component 30 show up a special symbol which is not included in the game result generating component 20, and a special reward effects is provided when the special symbol showed up.

Figure 7:
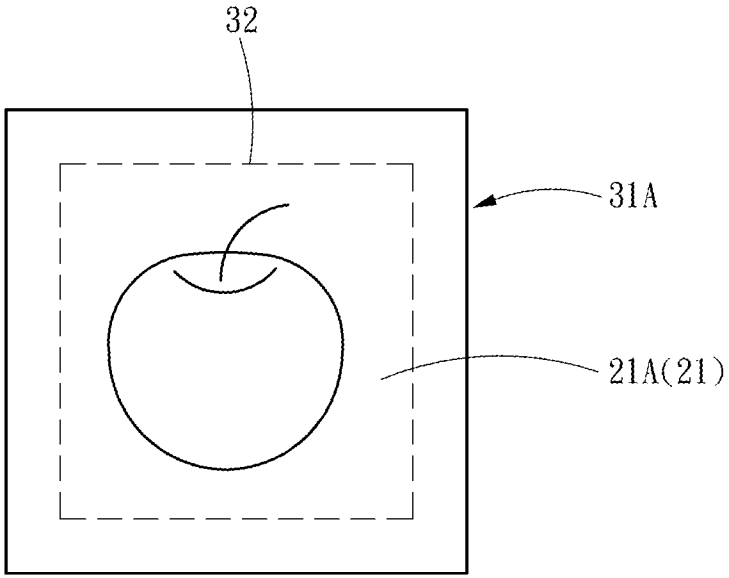
FIG. 7 is a schematic diagram of a game symbol displaying by the three-dimensional re-spinning component of the present invention.

Referring to FIGS. 5 and 7, the three-dimensional re-spinning component 30 randomly selects any one of the at least four display surfaces 32. The stereoscopic image 31A of the three-dimensional re-spinning component 30 described herein is illustrated by a six sided dice. In addition, the stereoscopic image 31A presents a randomly selecting process in a stereoscopic spinning manner (as shown in FIG. 5), and the three-dimensional re-spinning component 30 displays one of the display surfaces 32 that being selected to face in front (as shown in FIG. 7). The three-dimensional re-spinning component 30 makes one of the game symbols 21 corresponding to one of the display surfaces 32 that being selected as a replacement game symbol 21A. In order to attract a player's gaze and attention, the three-dimensional re-spinning component 30 is able to display the stereoscopic image 31A on the game screen 11 in any one of displaying manners of enlargement, highlighting, and high contrast color, etc., as shown in FIG. 5, is indicated with an enlargement effect.

The reward unit 40, as shown in FIG. 2, performs a reward program when the slot game instantaneously generates the game result which satisfies a reward condition. The reward program allows the player to additionally perform an extra game, wherein game modes of the extra game can be selected from re-spinning of rollers, bonus game, free game, retrigger, and jackpot, etc., or the reward program is provided to award extra scores.

Figure 8:
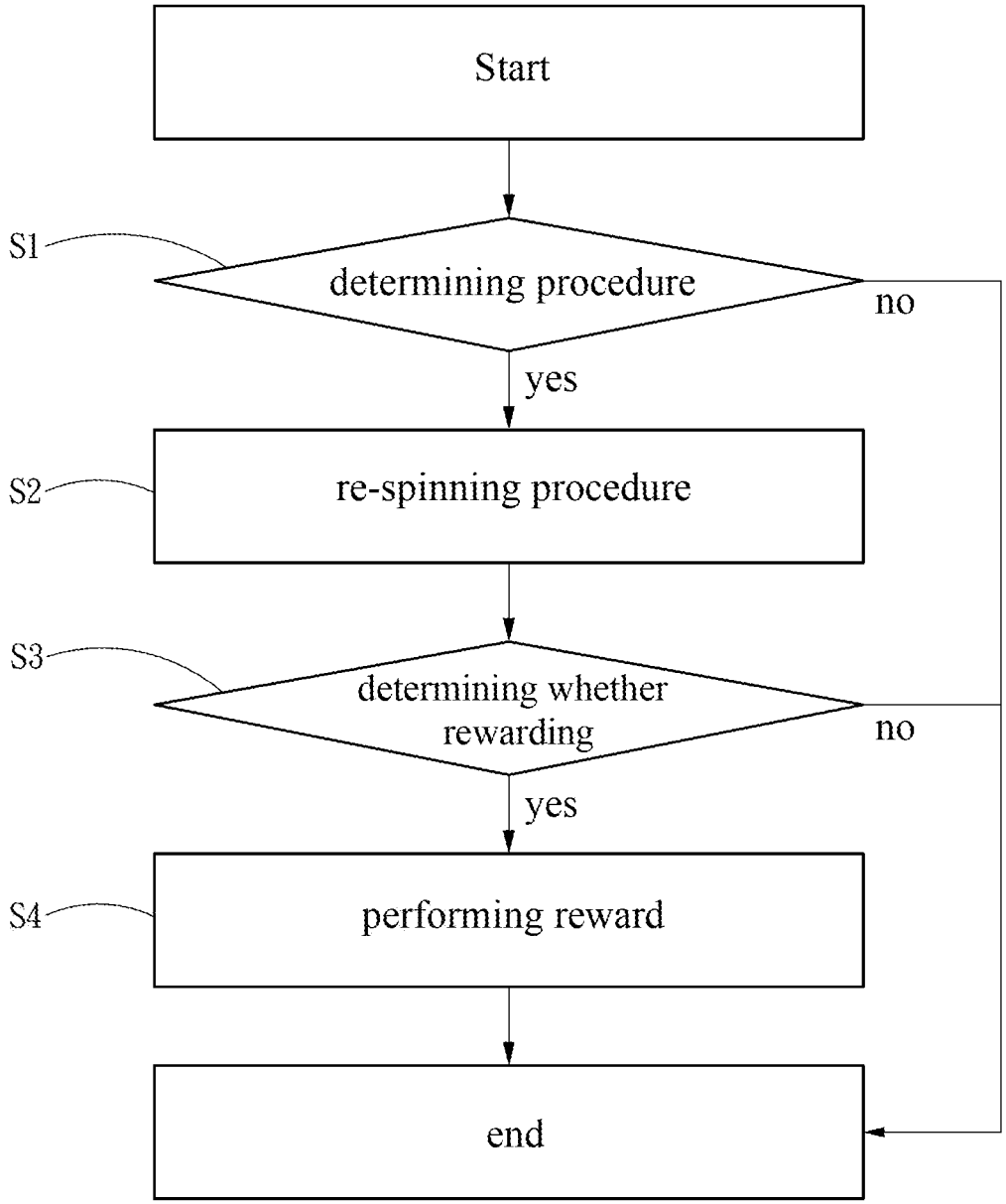
FIG. 8 is a flow chart of steps of the present invention.

Referring to FIG. 8, the control unit 50 is connected to the display component 10, the game result generating component 20, the three-dimensional re-spinning component 30 and the reward unit 40, and the control unit 50 controls the game to perform the following steps: step S1: determining procedure, step S2: re-spinning procedure, step S3: determining whether rewarding, and step S4: performing reward.

Figure 9A:
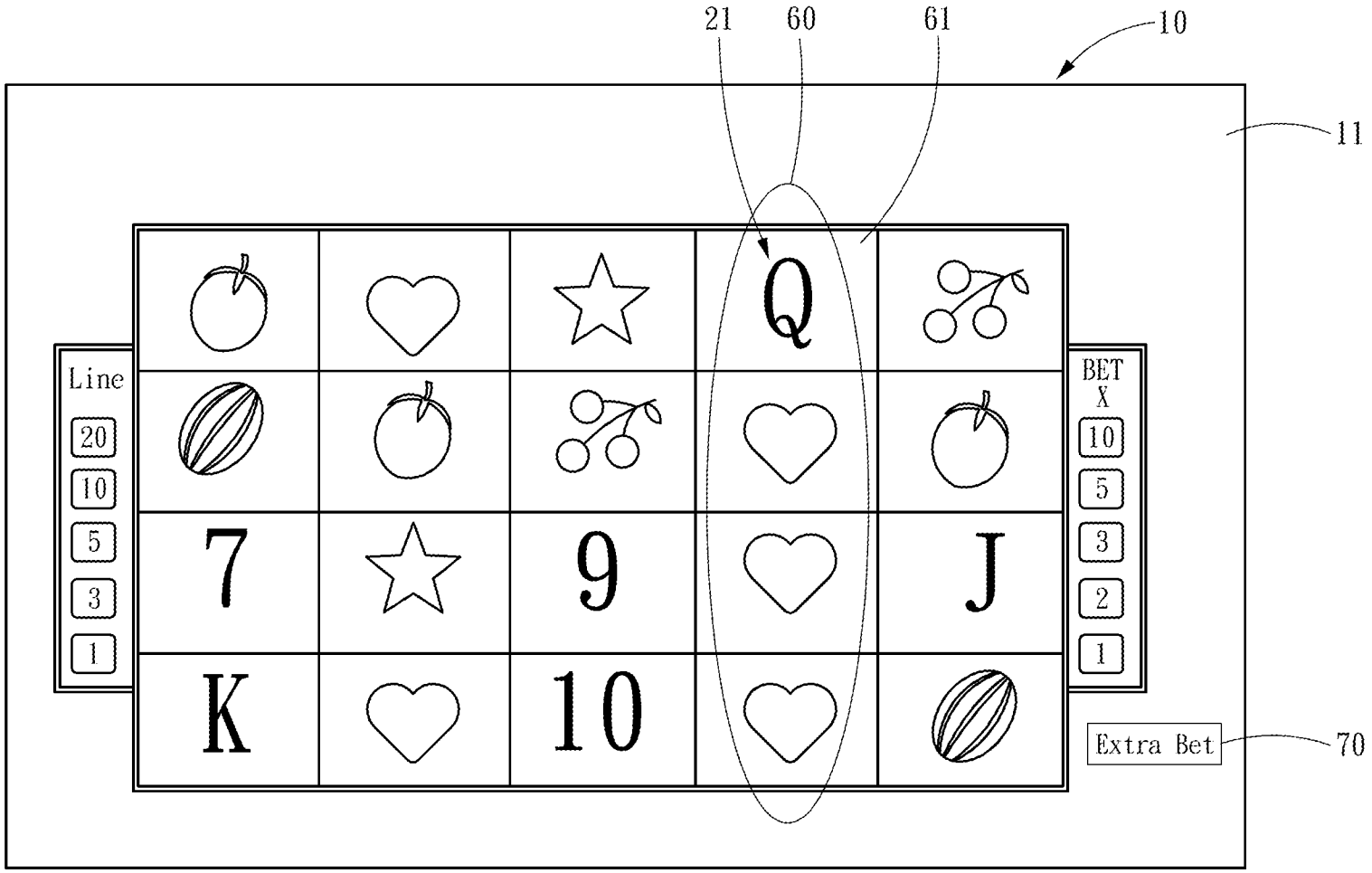
FIG. 9A is a schematic diagram of a specified condition being satisfied on the game screen according to the present invention.

Referring to FIG. 9A, first, performing the step S1: determining procedure, the control unit 50 determining whether the slot game instantaneously generates the game result which satisfies a specified condition, the specified condition is that any one of the plurality of game symbols 21 in the game result is replaced so that the reward condition may be satisfied, and one of the game symbols 21 that being replaced to be located at a replacement position 61. "Any one of the plurality of game symbols 21 in the game result is replaced so that the reward condition may be satisfied" described herein means that, for example, as shown in FIG. 9A, the game screen 11 comprises the plurality of game symbols 21 arranged in a 4×5 matrix, hypothetically, the reward condition is that the plurality of game symbols 21 in the row are all heart symbols, in other words, the reward condition is satisfied when the plurality of game symbols 21 in any row are four heart symbols. As shown a loop 60, the specified condition is satisfied when the game symbols 21 of the row are three heart symbols, because the reward condition may be satisfied if one of the game symbols 21 (which is located at the replacement position 61) that is not the heart symbol to be replaced in the row.

When the control unit 50 determines that the game result satisfies the specified condition, the control unit 50 generates an activation signal. In practical operation, it is also acceptable to implement another embodiment, when the control unit 50 determines that the game result satisfies the specified condition, the control unit 50 generates the activation signal by randomly triggered, in other words, the activation signal is not generated by the control unit 50 every time, thereby a randomly triggered manner is capable of maintaining the operating profit that the system (the dealer) should possess; of course, when the specified condition is satisfied, the control unit 50 also can generate the activation signal every time to fully perform effectiveness of attracting the player.

Figure 9B:
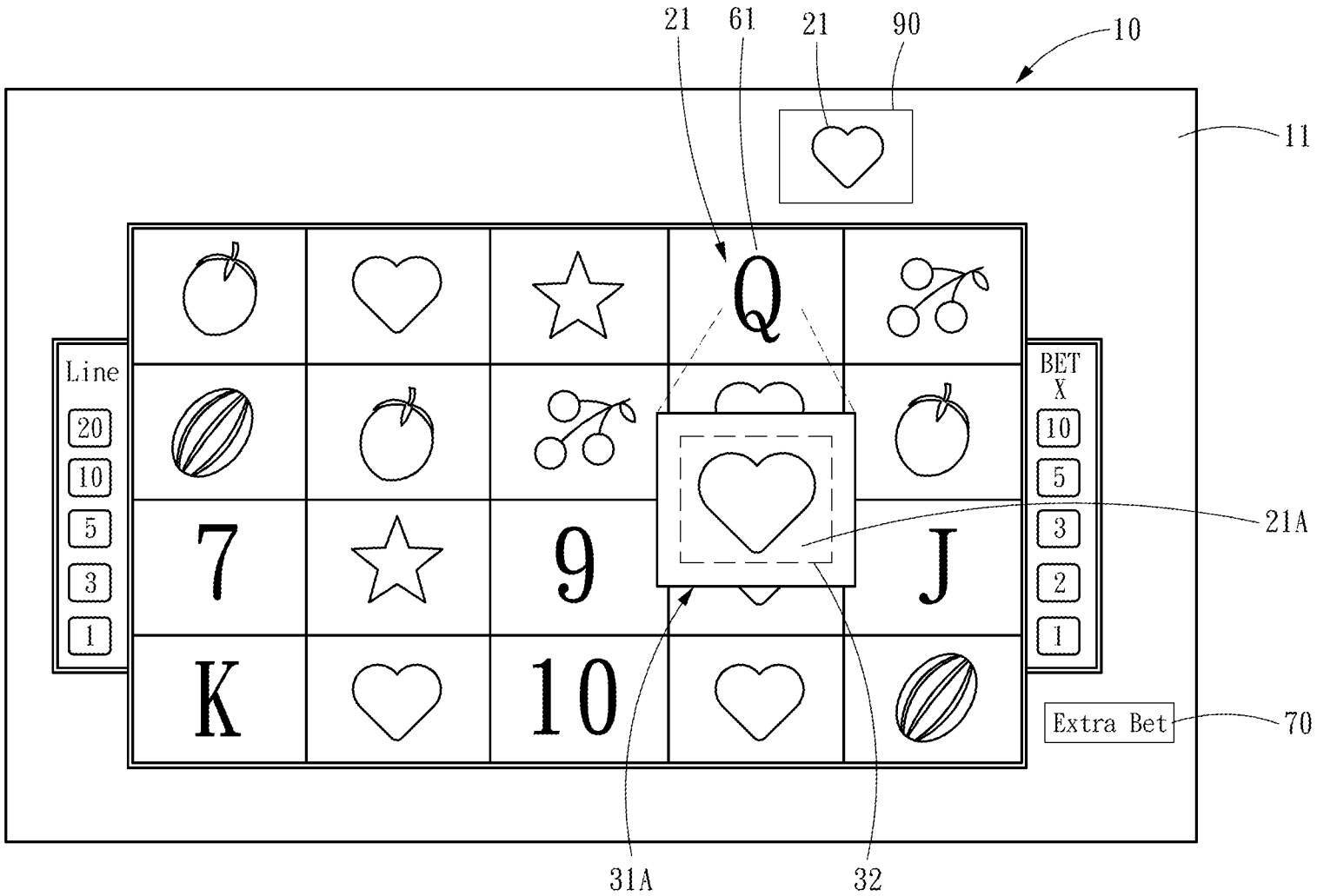
FIG. 9B is a schematic diagram of a replacement game symbol being generated on the game screen according to the present invention.

Then, performing the step S2: re-spinning procedure, the control unit 50 transmitting the activation signal to the three-dimensional re-spinning component 30, after receiving the activation signal, the three-dimensional re-spinning component 30 spinning the stereoscopic image 31A, and displaying one of the display surfaces 32 the being selected to face in front, and generating the replacement game symbol 21A (as shown in FIG. 9B), and the replacement game symbol 21A being used to replace the game symbol 21 that located at the replacement position 61 and thereby update the game result.

Next, performing the step S3: determining whether rewarding, the control unit 50 re-determining whether the updated game result satisfying the reward condition, if yes, the control unit 50 generating a reward signal, as shown in FIG. 9B. When the replacement game symbol 21A is a heart symbol, the control unit 50 determines that the reward condition is satisfied and generates the reward signal.

Finally, performing the step S4: performing reward, the control unit 50 notifying the reward unit 40 to perform the reward program.

Figure 10:
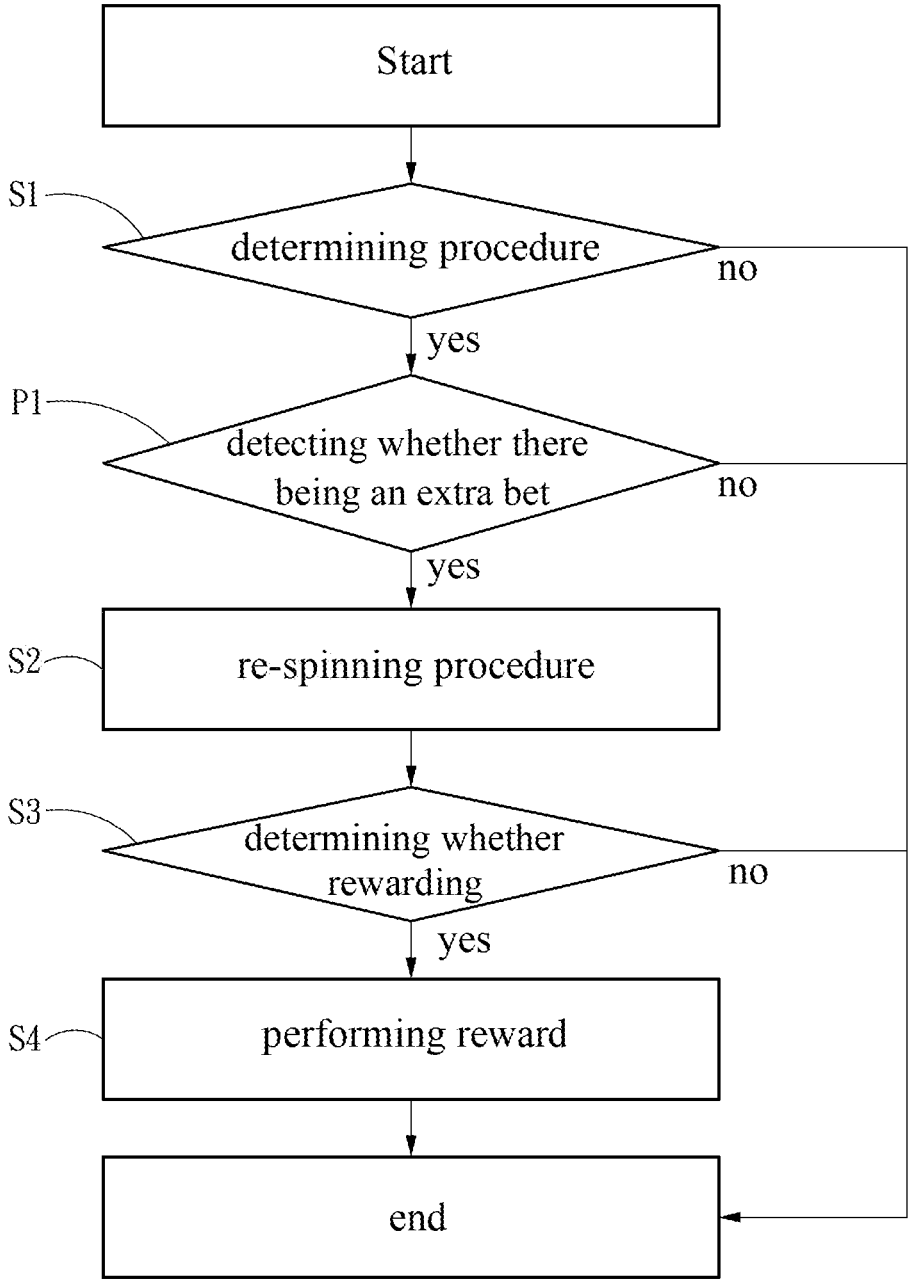
FIG. 10 is a flow chart of the steps according to another implementation mode of the present invention.

Please refer to FIG. 10, which is a flow chart of the steps according to another implementation embodiment of the present invention. After the control unit 50 generating the activation signal, the control unit 50 first performing step P1: detecting whether there being an extra bet, when the control unit 50 detecting that there being an extra bet, proceeding to the step S2: re-spinning procedure. More specifically, the game system will provide an extra bet option 70, as shown in FIG. 3, the extra bet option 70 can be labeled as "Extra Bet", and the player must place a bet on the extra bet option 70 before the game system proceeds to the step S2. That is to say, the player must have additional bets in order to trigger the three-dimensional re-spinning mechanism, thereby further increasing the amount of bets while effectively maintaining the operating profit that the system (the dealer) should possess.

Figure 11:
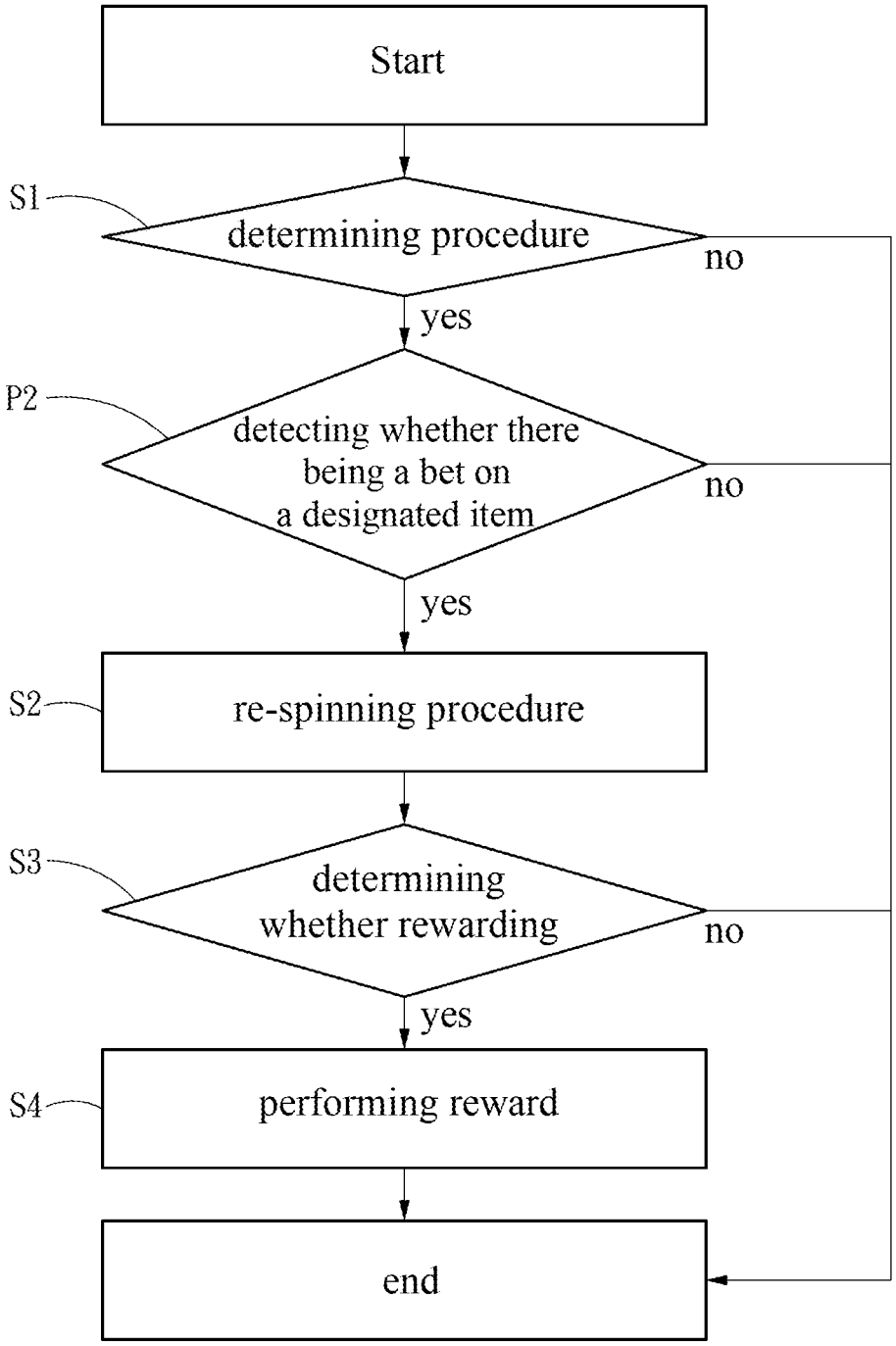
FIG. 11 is a flow chart of the steps according to still another implementation mode of the present invention.

Please refer to FIG. 11, a flow chart of the steps according to another implementation embodiment of the present invention. After the control unit 50 generating the activation signal, the control unit 50 first performing step P2: detecting whether there being a bet on a designated item, when the control unit 50 detecting whether there is a bet on a designated item 80, proceeding to the step S2: re-spinning procedure. More specifically, the game system selects at least one bet item as the designated item 80 from the existing bet items. As shown in FIG. 3, "Line20" can be specified as the designated item 80, and the player must place a bet on the designated item 80 "Line20" before the game system proceeds to the step S2, that is, the player must have betted on the designated item 80 in order to trigger the three-dimensional re-spinning mechanism. The designated item 80 is an item with a higher operating profit in the system (for the dealer), and thus can also effectively maintain the operating profit that the system (the dealer) should possess.

In addition, as shown in FIGS. 5, 6 and 9B, in order for the player to actually enjoy similar excitement of squinting a card, the game screen 11 of the display component 10 displays a prompt area 90 when the stereoscopic image 31A appears. Before the control unit 50 performing the step S2, in order to advanced calculate and learn of the game symbol 21 that being absent at the replacement position 61 for satisfying the reward condition, and the control unit 50 notifies the display component 10 to display the game symbol 21 that being absent under the reward condition in the prompt area 90. As shown in FIGS. 5 and 6, the game symbol 21 that being absent is a gold ingot under the reward condition; and as shown in FIG. 9B, the game symbol 21 that being absent is a heart symbol under the reward condition.

Accordingly, the player clearly knows which type of the plurality of game symbols 21 that the replacement game symbol 21A generated by the three-dimensional re-spinning component 30 is able to satisfy the reward condition, so that the player can enjoy similar excitement of squinting a card.

In summary, the advantages of the present invention at least include:

1. According to the determining procedure of the control unit that allows the three-dimensional re-spinning component having the opportunity to generate the replacement game symbol and update the game result so that the player would re-expect to satisfy the reward condition, thereby maintaining the enjoyment of the player.

2. By displaying the prompt area of the game screen, the player can clearly know the game symbol that being absent under the reward condition before the three-dimensional re-spinning component spins, thus the player is given a similar excitement of squinting a card by the operation of the three-dimensional re-spinning component, thereby enhancing the player's interest in playing.

What is claimed is:

1. A game system with mechanism for determining whether to trigger three-dimensional re-spinning, the game system is applied to a slot game which is including a plurality of game results, and the game system comprising:

a display component, the display component comprising a game screen for displaying a real-time image of the slot game;

a game result generating component, the game result generating component generating a plurality of game symbols, the plurality of game symbols being displayed side by side on the game screen, and the slot game constituting the different game results according to arrange the type of the plurality of game symbols;

a three-dimensional re-spinning component, the three-dimensional re-spinning component comprising a stereoscopic image displayed on the game screen, the stereoscopic image comprising at least four display surfaces arranged stereoscopically, the at least four display surfaces respectively comprising one of the game symbols, the three-dimensional re-spinning component randomly selecting any one of the at least four display surfaces, the stereoscopic image presenting a randomly selecting process in a stereoscopic spinning manner, and the three-dimensional re-spinning component displaying one of the display surfaces that being selected to face in front, and at the same time the three-dimensional re-spinning component making one of the game symbols corresponding to one of the display surfaces that being selected as a replacement game symbol;

a reward unit, the reward unit performing a reward program when the slot game instantaneously generating the game result that satisfying a reward condition; and a control unit, the control unit being connected to the display component, the game result generating component, the three-dimensional re-spinning component, and the reward unit, and the control unit controlling the game to perform following steps:

step S1: determining procedure, the control unit determining whether the slot game instantaneously generating the game result that satisfying a specified condition, the specified condition defined as any one of the plurality of game symbols in the game result replaced so that the reward condition may be satisfied, and one of the game symbols replaced to be located at a replacement position, and when the control unit determining that the game result satisfying the specified condition, the control unit generating an activation signal;

step S2: re-spinning procedure, the control unit transmitting the activation signal to the three-dimensional re-spinning component, the three-dimensional re-spinning component generating only a single replacement game symbol after receiving the activation signal, and the single replacement game symbol being used to replace the game symbol at the replacement position and update the game result;

step S3: determining whether rewarding, the control unit re-determining whether the updated game result satisfying the reward condition, if yes, the control unit generating a reward signal; and step S4: performing reward, the control unit notifying the reward unit to perform the reward program.

2. The game system as claimed in claim 1, wherein the game result generating component is a plurality of roller elements, wherein the plurality of roller elements generate the plurality of game symbols.

3. The game system as claimed in claim 2, wherein the plurality of game symbols are respectively generated by a corresponding number of the plurality of roller elements.

4. The game system as claimed in claim 2, wherein the plurality of roller elements generates the plurality of game symbols in a row.

5. The game system as claimed in claim 1, wherein the reward program allows a player to additionally perform an extra game.

6. The game system as claimed in claim 1, wherein when the specified condition is satisfied, the control unit generates the activation signal by randomly triggered.

7. The game system as claimed in claim 1, wherein after the control unit generates the activation signal, the control unit first performs step P1: detecting whether there is an extra bet, when the control unit detecting the extra bet, proceeds to the step S2: re-spinning procedure.

8. The game system as claimed in claim 1, wherein after the control unit generates the activation signal, the control unit first performs step P2: detecting whether there is a bet on a designated item, when the control unit detects that there is the bet on the designated item, proceeds to the step S2: re-spinning procedure.

9. The game system as claimed in claim 1, wherein the types of the game symbol of the three-dimensional re-spinning component are the same as the types of the game symbols of the game result generating component.

10. The game system as claimed in claim 1, wherein a quantity of the types of the game symbol of the three-dimensional re-spinning component is more than the types of the game symbols of the game result generating component.

11. The game system as claimed in claim 1, wherein the stereoscopic image of the three-dimensional re-spinning component is a six-sided dice.

12. The game system as claimed in claim 1, wherein the three-dimensional re-spinning component displays the stereoscopic image on the game screen in any one of displaying manners of enlargement, highlighting, and high contrast color.

13. The game system as claimed in claim 1, wherein the game screen of the display component displays a prompt area when the stereoscopic image appears, before the control unit performing the step S2, in order to further calculate and learn of the game symbol that being absent at the replacement position for satisfying the reward condition, and the control unit notifies the display component to display the game symbol that being absent under the reward condition in the prompt area.

* * * * *